United States Patent [19]

Matsushita et al.

[11] 3,948,691

[45] Apr. 6, 1976

[54] METHOD FOR MANUFACTURING COLD ROLLED, NON-DIRECTIONAL ELECTRICAL STEEL SHEETS AND STRIPS HAVING A HIGH MAGNETIC FLUX DENSITY

[75] Inventors: Izumi Matsushita; Takayasu Sugiyama; Masakatsu Sumimoto; Osamu Honjo, all of Himeji, Japan

[73] Assignee: Nippon Steel Corporation, Tokyo, Japan

[22] Filed: June 21, 1974

[21] Appl. No.: 481,890

Related U.S. Application Data

[63] Continuation-in-part of Ser. No. 391,019, Aug. 23, 1973, abandoned, which is a continuation of Ser. No. 183,323, Sept. 24, 1971, abandoned.

[30] Foreign Application Priority Data

Sept. 26, 1970 Japan ..... 45-83780

[52] U.S. Cl. ..... 148/112; 148/31.55; 148/111

[51] Int. Cl.[2] ..... H01F 1/04

[58] Field of Search ..... 148/111, 110, 112, 113, 148/31.55, 120, 121, 11.5 R; 75/124; 164/273 R, 282, 283

[56] References Cited

UNITED STATES PATENTS

| | | | |
|---|---|---|---|
| 2,193,768 | 3/1940 | Masumoto et al. | 75/124 |
| 3,061,486 | 10/1962 | Jackson | 148/111 |
| 3,159,511 | 12/1964 | Taguchi et al. | 148/111 |
| 3,164,496 | 1/1965 | Hibbard et al. | 148/120 |
| 3,203,839 | 8/1965 | Takahashi | 148/113 |
| 3,620,856 | 11/1971 | Hiraoka | 148/121 |
| 3,671,337 | 6/1972 | Kumai et al. | 148/111 |
| 3,764,406 | 10/1973 | Littmann | 148/111 |

OTHER PUBLICATIONS

Sachs, G., et al.; *Practical Metallurgy*, Practical Metallurgy, Cleveland (ASM) 1940 pp. 24–33.

Barrett, C., et al.; *Structure of Metals*, New York, 1966 pp. 535–536.

*Primary Examiner*—Walter R. Satterfield

*Attorney, Agent, or Firm*—Toren, McGeady and Stanger

[57] ABSTRACT

A method for manufacturing cold rolled, nondirectional electrical steel sheets and strips having a high magnetic flux density wherein a molten steel is solidified to obtain a slab in a manner that columnar grains develop predominantly from the surface in the direction of thickness of the slab up to a depth of more than 50%; said slab is heated to a temperature above 1000°C without cogging and rolling to form $\gamma$-phase at least more than about 10% of said slab, and hot rolled strongly with a draft of more than 98% without reheating to obtain a hot rolled steel sheet; and said hot rolled steel sheet is cold rolled with a draft of 64 – 84%, heated with a heating velocity of more than 1.6°C/sec., and annealed at a temperature of 600° – 1200°C.

1 Claim, 9 Drawing Figures

INVENTORS
IZUMI MATSUSHITA
TAKAYASU SUGIYAMA
MASAHATSU SUMIMOTO
OSAMU HONJO

BY Foren and McGeady
ATTORNEY

EXAMPLE 1

EXAMPLE 2

EXAMPLE 3

METHOD FOR MANUFACTURING COLD ROLLED, NON-DIRECTIONAL ELECTRICAL STEEL SHEETS AND STRIPS HAVING A HIGH MAGNETIC FLUX DENSITY

CROSS REFERENCES TO RELATED APPLICATIONS

This application is a continuation-in-part of copending application serial No. 391,019, filed Aug. 23, 1973, now abandoned which in turn, is a continuation of application serial No. 183,323, filed Sept. 24, 1971 now abandoned.

BACKGROUND OF THE INVENTION

1. Field of the Invention:

This invention relates to a method for manufacturing cold rolled, nondirectional electrical steel sheet and strip.

2. Description of the Prior Art:

Since cold rolled, nondirectional electrical steel sheet and strip is used chiefly for rotary electrical instruments, it is desirable that the sheet have uniform magnetic characteristics with no distinct orientation in any direction within the plane of the sheet or strip (hereinafter referred to as sheet).

In the mass production of such electrical steel sheet which possesses essentially uniform magnetic characteristics in all directions in the plane of the sheet, technical efforts have hitherto been made to orient the crystals constituting the steel sheet in a random direction.

However, alloy steels, such as, carbon steel, silicon steel, and aluminium steel for use as electrical steel sheet are constituted of $\alpha$-phase, i.e., crystals having body centered cubic lattice at room temperature, and as it is well known, it is most difficult to obtain magnetization of the direction described as <111> by means of Miller's notation.

Conventional cold rolled, nondirectional electrical steel sheets comprising crystals having a random direction contain many crystals having the direction of <111> as the direction of magnetization. Accordingly, although they are non-orientating, they have only a relatively low magnetic flux density in all directions.

On the other hand, methods for manufacturing electrical steel sheet having a crystal orientation so as to contain many crystals having <100> direction which is favourable for magnetization in the plane of the sheet, i.e., two-directional electrical steel sheet composed of crystals having the orientation of (100)[001] described by Miller's notation, or the so-called "poly-directional" electrical steel sheet comprising crystals having the orientation of (100) [OKI] have been proposed. However, many of these are not suitable for mass production, because the manufacturable grades are restricted due to the limitations in the components or to the very precise treatment required in the course of manufacture.

SUMMARY OF THE INVENTION

The object of the present invention is to offer an economical method for manufacturing steel sheet having a uniform and tolerably high magnetic flux density in all directions in the plane of the sheet. This is accomplished in the manufacture of cold rolled, nondirectional electrical steel sheet of all grades containing varying amounts of elements, such as, silicon, aluminium and carbon, wherein the crystals having an orientation unsuitable for magnetic characteristics, which are formed in the conventional electrical steel sheet from the slab obtained by the usual ingot breaking-down method are intentionally reduced, and the amount of crystals having an orientation of (110)[001] is increased.

Another object of this invention is to produce cold rolled, nondirectional steel sheet having a high magnetic flux density by a continuous casting or similar method.

More particularly, the present invention relates to a method for manufacturing cold rolled, nondirectional electrical steel sheet having a high magnetic flux density having less than 4% silicon, less than 3% aluminium and less than 0.1% carbon with the remainder being chiefly iron. For example, the electrical steel sheet according to the present invention shows higher magnetic flux densities of $B_{20}$ and $B_{40}$ by more than 0.02 wb/m$^2$ than those of an electrical steel sheet according to the conventional method. The method comprises:

a. continuously casting molten steel into a slab at a molten steel pouring temperature of greater than about 30°C to 70°C above the liquidus temperature, and solidifying the molten steel at a cooling water to molten steel rate of from about 0.5 to 3 liters/kg of steel, said molten steel having carbon, silicon, and aluminium contents within the ranges shown in FIG. 8 thereof so as to produce at least more than about 10% of gamma phase in said slab upon heating in accordance with step (b) hereof to obtain a slab in which columnar grains are developed predominantly from the surface in the direction of the thickness of the slab to a depth of more than about 50% of the slab;

b. heating the slab to a temperature range from about 1000 to 1350°C for a period of time sufficient to heat the entire slab uniformly without breaking it down to produce more than about 10% of gamma phase in the slab;

c. hot rolling the slab along the plane perpendicular to the direction of the developing columnar grains with a reduction of greater than about 98% to produce a sheet of intermediate gauge;

d. acid pickling the hot rolled sheet;

e. cold rolling the sheet with a reduction from about 64 – 84%;

f. heating the cold rolled sheet at a heating rate of from about 1.6° to 100°C/second; and g. annealing the material at a temperature between about 600° to 1200°C for more than 10 seconds.

DESCRIPTION OF THE PREFERRED EMBODIMENT

While the crystal orientation of a steel changes generally to a random direction by the phase transformation, as it is well known in the art, the manner of $\alpha$-$\gamma$transformation of the alloy steel changes according to the amounts of silicon, aluminium, carbon and the like contained in the steel, and in some instances, no transformation occurs, depending on the combination of alloy elements.

Generally, increasing amounts of silicon and aluminium diminish the region of $\gamma$-phase or the region of the coexistence of $\alpha$-phase and $\gamma$-phase. Particularly when more than 2.5% of silicon or more than 1% of aluminium and less than 0.025% of carbon are present, no transformation takes place. On the other hand, increasing the amount of carbon enlarges the region of $\gamma$-phase and, particularly, the region of the coexistence of $\alpha$-phase and $\gamma$-phase. Therefore, by adding more than 2.5% of silicon or more than 1% of aluminium in the present invention, it is possible to produce $\gamma$-phase in at least a part of the slab at 1000°C by making the carbon content greater than 0.026%.

Figure 8:
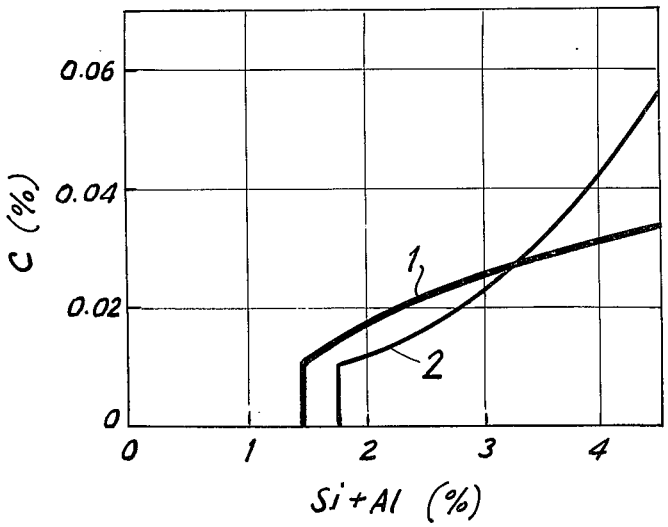
FIG. 8 is a graph showing the relationship between the composition and the amount of carbon required for assuring that at least 10% of the slab is of gamma phase.

Referring particularly to FIG. 8, the relationship between the amounts of Si, Al, and C, to produce gamma phase at least 10% of the slab during the slab heating stage and the slab heating temperature in accordance with the present process is shown. A desirable result can be obtained when the obliqued line region (the range where the carbon content is higher than the curve) is used. In FIG. 8, (1) and (2) represent cases wherein the slab is heated at 1000°C, and higher than 1100°C, respectively.

The purpose of adding silicon and aluminium is to increase the electrical specific resistance of the alloy steel and decrease the eddy current loss as well as the iron loss. However, the existence of more than 4% of silicon or more than 3% of aluminium should be avoided, because the cold rolling becomes difficult and the saturated magnetic flux density decreases. While carbon is an important element, as mentioned above, to control the phase transformation of the alloy steel, the existence of more than 0.1% of carbon is undesirable, because the decarburization treatment becomes difficult. Additionally, the magnetic aging of the product increases to undesirable levels.

To illustrate the relationship between the component elements and the phase transformation, when both silicon and aluminium are absent at 1000°C, the steel always exists as $\gamma$-phase so long as the carbon content is less than 0.1%. In the case of a steel containing 1.5% of silicon and 0.20% of aluminium, it is possible to produce $\gamma$-phase in at least a part of the alloy steel at 1000°C by insuring that it contains 0.01 – 0.1% of carbon. In the case of a steel containing 3.0% silicon and 0.25% aluminium, it is possible to make a part of the alloy steel at 1000°C, $\gamma$-phase by having it contain 0.03 – 0.1% of carbon. Preferably, the molten steel contains between about 0.003 to 0.1% carbon, less than about 4% silicon and less than about 3% aluminium.

In applying this invention, it is necessary to roll the slab strongly with a draft of more than 98% without reheating. As the temperature of the slab decreases rapidly with decreasing thickness, a heating temperature of at least 1000°C is necessary in order to avoid the temperature decreasing to a range where the hot rolling becomes difficult before the final gauge is attained. The highest temperature of heating is about 1350°C, and there is no need to heat above that temperature. In using heating temperatures above 1000°C, the amount of carbon necessary to form $\gamma$-phase at least in a part of the slab at the corresponding temperature is somewhat decreased as compared with the case of heating to 1000°C. The details in this concern can be seen, for example, in "Ferro-Magnetism" by R. M. Bozorth.

It is known that when an alloy steel is solidified under suitable conditions, large crystals having a random direction, i.e., so-called columnar grains, having a [001] orientation almost parallel to the cooling direction, and, consequently, a (100) plane almost parallel to the surface of the ingot develop.

The present inventors have discovered that when a molten steel whose components are controlled so as to contain $\gamma$-phase in at least a part of the alloy steel at a temperature above 1000°C, is solidified in a manner such that columnar grains develop predominantly from the surface to occupy more than 50% of the thickness, and is heated at a temperature above 1000°C to obtain a slab having $\gamma$-phase in at least a part of the alloy steel, and said slab is rolled from said temperature without reheating with a draft of more than 98% to obtain a hot rolled steel sheet, then, although the surface of the raw material consisted of crystals having a (100) plane, said orientation is destroyed completely. Moreover, crystals having an orientation (100)[001], which is quite different from the orientation of the raw material, develop predominantly from the surface of the hot rolled steel sheet to about ½ of the thickness of the hot rolled steel sheet. It has been further ascertained that, when the hot rolled steel sheet is cold rolled and annealed under specified conditions, steel sheets having substantially different characteristics as compared with a steel sheet obtained from a slab having no columnar grains produced by cogging and rolling a steel ingot in the conventional way, can be obtained. While the surface part of the steel sheet consists of crystals having poor magnetic characteristics in the latter case, the steel sheets of this invention have a high magnetic flux density which is relatively uniform in all directions of the plane of the sheet because of the fact that crystals having an orientation of (110)[001] are well developed at the surface part of the steel sheet and crystals having the orientation of (hkl)[021] exist at the central part thereof.

Methods such as the use of a flat mold and continuous casting are applicable as a method for manufacturing the slab in this invention. However, from the standpoint of the uniformity of the quality and economy, the continuous casting method is superior.

In manufacturing a slab by continuous casting, it is desirable that the pouring temperature is 30° – 70°C higher than the liquidus line. When the pouring temperature is lower than this range, the development of the necessary columnar grains is insufficient and the phenomenon of plate out takes place above this range.

It is desirable that the cooling velocity of the steel poured in the mold is 0.5 – 3 l of cooling water/kg-steel, preferably, more than 0.8 l of water/kg-steel, and the maximum drawing velocity is 1.5 m/min. By adhering to the above pouring temperatures and cooling velocities, the development of columnar grains to a depth of more than 50% of the slab thickness can be assured.

The thickness of the slab should be selected, in accordance with the final gauge of the product, so as to satisfy the drafts of hot and cold rolling necessary for the application of this invention. A satisfactory hot rolled steel sheet having a crystal orientation in the characteristic of this invention cannot be obtained when the columnar grains developed from the surface of the slab during solidification do not occupy more than 50% of the thickness.

While not being limited to any theory, it is assumed that, in the hot rolling of the slab in which columnar grains occupy more than 50% of the thickness, while the columnar grains in the raw material slab are completely destroyed when the rolling is commenced from the state containing the $\gamma$-phase and carried out under a strong reduction with a draft of more than 98% without reheating, since the surface part of the original slab consists of columnar grains having a relatively regular orientation, the crystals in the hot rolled steel sheet change to the orientation of (110)[001] with high uniformity, thus differing completely from the orientation in the raw material, by virtue of the hot rolling.

The methods described in U.S. Pat. Nos. 3,061,486, and 3,130,090 disclose the hot rolling of a starting ingot containing 2.0 – 3.5% of silicon and having well developed columnar grains, without destroying the crystal orientation of the raw material to form a hot rolled steel sheet having a (100) plane parallel to the plane of the hot rolled steel sheet as it is in the raw material. It is obvious that this method is quite different from the present invention in which the orientation of the raw material containing $\gamma$-phase at the commencement of the hot rolling is completely destroyed under a strong reduction with a draft of more than 98%, and a hot rolled steel sheet having a quite different orientation is manufactured.

By decreasing the hot rolling draft less than 98%, the amount of crystals having the (110)[001] orientation at the surface decreases rapidly. When the alloy steel at the temperature of heating consists entirely of $\gamma$-phase, the influence of the original orientation is retained even under a high reduction with the draft of more than 98%, and the hot rolled steel sheet consisting chiefly of crystals having the (110)[001]orientation at the surface part can not be obtained. Therefore, in applying this invention, it is necessary to heat the raw material to a temperature sufficiently high such that at least a part of the alloy exists as $\gamma$-phase, and to apply a high reduction with a draft of more than 98%.

Figure 1:
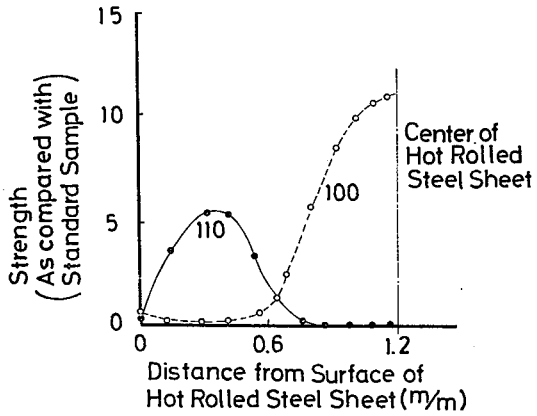
FIG. 1 is a graph showing the relation between the crystal orientation of the hot rolled steel sheet obtained according to this invention and the depth from the surface of said steel sheet.

FIG. 1 shows the distribution of the crystal orientation in the direction of the thickness of the hot rolled steel sheet in the application of this invention in which an alloy steel comprising 1.1% silicon, 0.22% aluminium and 0.032% carbon with the remainder being chiefly iron is cast continuously to obtain a slab having columnar grains developed from the surface of both sides of said slab to a depth of 85% of the sheet, and said slab is hot rolled with a draft of 98.5% after heating up to 1100°C.

Figure 2:
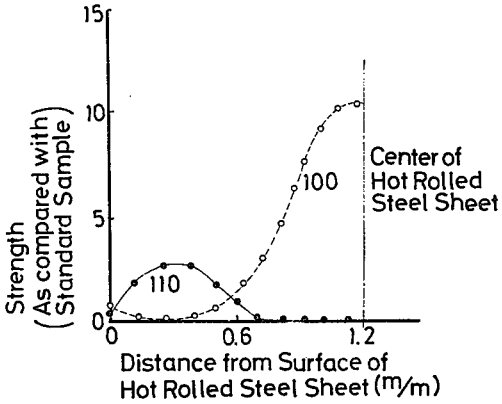
FIG. 2 is a graph showing the relation between the crystal orientation of the hot rolled steel sheet obtained by a conventional method of ingot making and the depth from the surface of said steel sheet.
Figure 3:
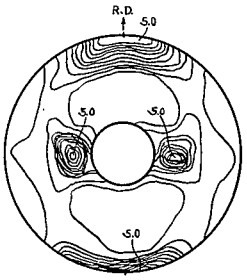
FIG. 3 is a (100) pole figure showing the crystal orientation constituting the surface part of the hot rolled steel sheet obtained by this invention.

It is known from the figure that the crystals having the (100) plane, i.e., the characteristic orientation of the original slab, is lost almost entirely in the hot rolled steel sheet, from the surface of both sides to about ½ of the sheet thickness, and the development of the (110) plane is remarkable. The result in the case of a hot rolled steel sheet obtained by a conventional method, in which a steel ingot having the same components as in this invention and manufactured by a usual ingot making is cogged and rolled, and the slab thus obtained is used as a raw material to obtain the hot rolled steel sheet, is shown in FIG. 2. The intensity of the (110) plane at the surface of the hot rolled steel sheet obtained from the continuous casting material of this invention is twice as strong as in the case of the conventional ingot material. The accurate orientation of said crystals in the case of the continuous casting material is as shown in FIG. 3, and it is clear that the orientation is (110)[001].

In the cold rolling of the hot rolled steel sheet obtained in this invention, it is necessary that the final gauge should be attained by a single rolling, and the cold rolling draft is in the range of 64 – 85%. Since the magnetic characteristics of the steel sheet and strip becomes rather inferior when the cold rolling within the above cold rolling draft range is carried out in more than two steps with an intermediate annealing, and then the final annealing is effected, such a procedure should be avoided.

When the cold rolling draft is less than 64%, the growth rate of crystals having an (110)[001] orientation after annealing increases excessively and accordingly the anisotropy increases. On the other hand, when the draft exceeds 86%, the growth rate of crystals having the (110)[001] orientation after annealing decreases rapidly. Consequently, both of these conditions should be avoided.

While an annealing is carried out before the cold rolling usually in order to homogenize the hot rolled steel sheet or for other purposes according to the conventional circumstances, the characteristic of the present invention is not lost by such an annealing, and thus, it is unnecessary to specify the conditions of said annealing.

In the final annealing of the cold rolled steel sheet and strip in this invention, the heating speed is particularly important, and a speed of 1.6° – 100°C/sec. is best. A slower speed should be avoided, because the rate of crystals having inferior magnetic characteristics increases over the entire steel sheet. The soaking temperature of the steel sheet and strip necessarily should be above the recrystallization temperature. This temperature is desirously above 600°C in order to improve the magnetic characteristics of the steel sheet and, particularly, to lower the iron loss. It is possible, if necessary, to raise the temperature to just below the transformation temperature of the steel sheet in order to promote the growth of crystal grains and to decrease the iron loss by raising the temperature.

While it is necessary, as mentioned above, that at least a part of the alloy steel exists as $\gamma$-phase in the heating necessary for the hot rolling, the phase transfomation in the final annealing after the hot rolled steel sheet is manufactured changes the characteristic crystal orientation in this invention to a random orientation, and moreover, carbon itself is rather harmful to the magnetic characteristics. Therefore, it is desirable that the decarburization is carried out in the annealing stage of the hot rolled steel sheet before the cold rolling or of the final annealing after cold rolling, since the reduction of the carbon content has a tendency, as already mentioned, to narrow the region of $\gamma$-phase or the region of the coexistence of $\alpha$-phase and $\gamma$-phase, the phase transformation temperature of the steel sheet after the decarburization is altered and, in some instances, the phase transformation does not take place even at still higher temperatures.

Although the $\alpha$-$\gamma$ transformaton disappears when an alloy steel containing more than 2.5% of silicon or 1% of aluminium is decarburized until the carbon content becomes less than 0.025%, the final annealing temperature of the alloy steel containing said components can sometimes be elevated above the heating temperature in the hot rolling. However, annealing at a temperature higher than 1200°C is not necessary, because such high temperature annealing is uneconomical and it is possible, in attempting to obtain a low iron loss, to easily obtain an electrical steel sheet having a similar iron loss by increasing the amounts of elements, such as silicon and aluminium. Therefore, the final annealing temperature in applying the present invention is in the range from about 600° – 1200°C. Moreover, since the grain growth is saturated after 10 minutes at a definite temperature in the annealing of the steel sheet, the annealing for a longer period is useless.

The scale decarburization using scale or an annealing atmosphere in which the ratio of $P_{H_2O}/P_{H_2}$(0.02 – 1.0) or $P_{CO_2}/P^2_{CO}$ (not less than 0.2) is controlled may be carried out using conventional condition well known in the art without altering the effects obtained by virtue of the present invention.

Figure 4:
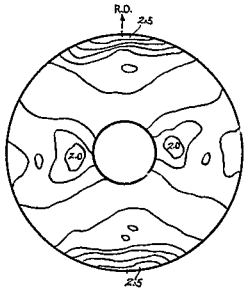
FIGS. 4 and 5 are (100) pole figures showing, respectively, the crystal orientation constituting the surface part and central part of the electrical steel strip obtained by this invention.
Figure 5:
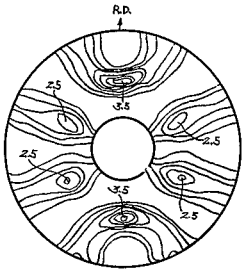

FIG. 4 is a (100) pole figure showing the crystal orientation constituting the surface part of the electrical steel strip in which a hot rolled steel sheet obtained by continuous casting as shown in FIG. 1, is acid pickled with hydrochloric acid, cold rolled with a draft of 78%, degreased, heated at a speed of 10°C/sec. in a decarburizing atmosphere of $P_{H_2O}/P_{H_2}$= 0.20 up to 820°C, held for 120 seconds at this temperature and air cooled, and FIG. 5 is a (100) pole figure showing the crystal orientation constituting the central part of said electrical steel strip.

The crystal orientations shown in FIG. 4 and FIG. 5 are quite different from the crystal orientation of the original slab and at the same time, the (110)[001] orientation is developed remarkably at the surface by the influence of the characteristic of the surface part of the hot rolled steel sheet of this invention.

Figure 6:
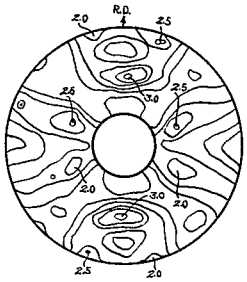
FIGS. 6 and 7 are (100) pole figures showing, respectively, the crystal orientation constituting the surface part and central part of the electrical steel strip obtained by a conventional method of ingot making.
Figure 7:
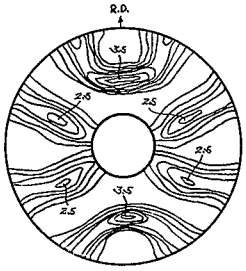

For comparison, the (100) pole figures constituting the surface and central parts of the conventional electrical steel strip in which a slab obtained by the usual ingot making method is treated, in the following stages after hot rolling, by the same procedure as in the above mentioned continuous casting method are shown in FIG. 6 and FIG. 7. While there is no difference between FIG. 5 and FIG. 7, it is obvious that, in comparing FIG. 4 and FIG. 6, crystals having the (110)[001] orientation are developed remarkably at the surface part of the continuous casting material of this invention.

The following examples show that by containing the proper amount of crystals having the (110)[001] orientation in an electrical steel sheet, the magnetic flux density is increased in all directions in the plane of the electrical steel sheet, and shows $B_{20}$ and $B_{40}$ values both more than 0.02 wb/m² higher than those obtained by the conventional method, without any or with only a slight increase of the anisotropy.

Figure 9:
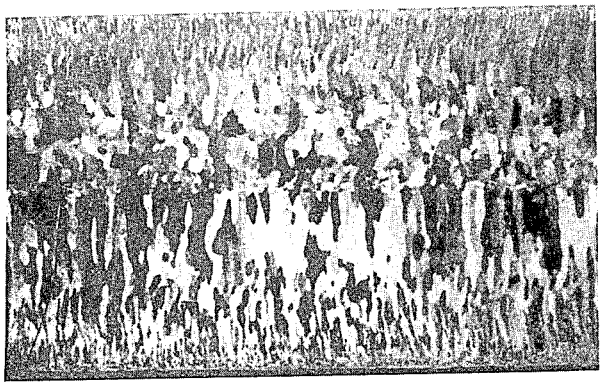
FIG. 9 is a series of three photo micrographs of cross sections of ingots obtained with the present process.
Figure 9:
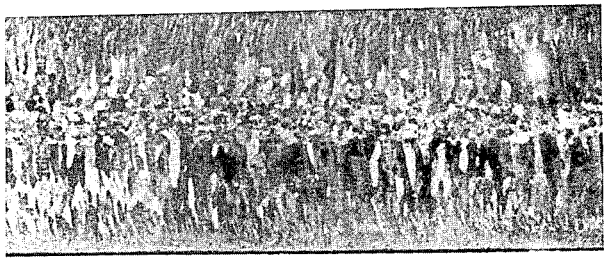
Figure 9:
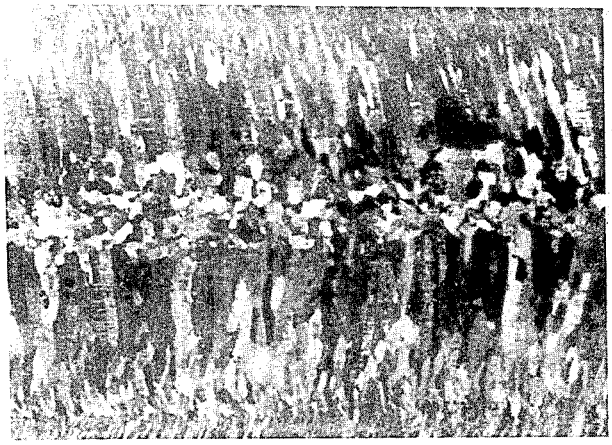

FIG. 9 sets forth three photomicrographs showing appropriate cross sections of the ingots obtained with examples 1, 2, and 3, respectively, of the present application, and are so designated. The photomicrograph of example 1 shows a columnar grain percentage of 80% (200 – 250) and that for example 2 shows a columnar grain percentage of 85% (140 – 155) while that of example 3 shows a columnar percentage of 87% (260 – 300). These photomicrographs clearly show the structure of the columnar grains which are growing from each of the surfaces of the ingot in accordance with the present invention.

EXAMPLE 1:

Molten steel comprising 1.12% silicon, 0.225% aluminum and 0.012% carbon, with the remainder being chiefly iron, was continuously cast into a slab having a thickness of 250 mm at a pouring temperature of 1564°C and solidified at a pouring water ratio of 2.5 l of water/kg of steel, whereby columnar grains developed from the surface of both sides to a depth of more than 100 mm. The slab was held for about 2 hours in a heating furnace whose temperature was mantained at 1220°C, and rolled with a draft of 99.1% to obtain a hot rolled steel sheet with a thickness of 2.3 mm. The hot rolled steel sheet was immersed in an acid solution containing chiefly hydrochloric acid to remove the oxide formed on the surface of the steel sheet during hot rolling, and cold rolled with a draft of 78.3% to obtain a thin steel strip with a thickness of 0.50 mm. The steel strip was degreased, and annealed by passing through a continuous bright annealing furnace, whose temperature was maintained at 820°C, having a strongly decarburizing atmosphere of $P_{H_2O}/P_{H_2}$= 0.20 under a heating velocity of 10.5°C/sec. and a soaking period of about 60 seconds. The magnetic properties of the steel strip obtained in this example and of a conventional steel strip obtained from the same steel by the usual ingot making method are compared in Table 1.

EXAMPLE 2:

Molten steel comprising 2.17% silicon, 0.209% aluminium, and 0.03% carbon with the remainder being chiefly iron was continuously cast into a slab having a thickness of 165 mm at a pouring temperature of 1552°C and solidified at a pouring water ratio of 2.0 l of water/kg of steel, whereby columnar grains developed from the surface of both sides to a depth of about 70 mm. The slab was held for about 2 hours in a heating furnace whose temperature was maintained at 1270°C, and rolled with a draft of 98.7% to obtain a hot rolled steel sheet with a thickness of 2.2 mm. The hot rolled steel sheet was immersed in an acid solution containing chiefly hydrochloric acid to remove the oxide formed on the surface of the steel sheet during the hot rolling, and cold rolled with a draft of 77.3% to obtain a thin steel strip with a thickness of 0.50 mm. The steel strip was degreased, and annealed by passing through a continuous bright annealing furnace whose temperature was maintained at 860°C, having a strongly decarburizing atmosphere of $P_{H_2O}/P_{H_2}$= 0.20 under a heating velocity of 11.8°C/sec. and a soaking period of about 60 seconds. The magnetic properties of the steel strip obtained in this example and of a conventional steel strip obtained from the same molten steel by the usual ingot making method are compared in Table 1.

EXAMPLE 3.

Molten steel comprising 2.90% silicon, 0.218% aluminium and 0.029% carbon, with the remainder being chiefly iron was continuously cast into a slab having a thickness of 300 mm at a pouring temperature of 1545°C and solidified at a pouring water ratio of 2.0 l of water/kg of steel, whereby columnar grains developed from the surface of both sides to a depth of about 130 mm. The slab was held for about 3 hours in a heating furnace whose temperature was maintained at 1150°C, and rolled with a draft of 99.3% to obtain a hot rolled steel sheet with a thickness of 2.0 mm. The hot rolled steel sheet was immersed in an acid solution containing chiefly hydrochloric acid to remove the oxide formed on the surface of the steel sheet during hot rolling and the loose coil of the steel sheet was annealed in an annealing box for 7 hours at 800°C in a strongly decarburizing atmosphere of $P_{H_2O}/P_{H_2} = 0.32$ to reduce the carbon content to 0.0032%. It was then cold rolled to obtain a thin steel strip with a thickness of 0.35 mm, which was degreased and annealed by passing through a continuous bright annealing furnace whose temperature was maintained at 1000°C and having a non-decarburizing, reducing atmosphere of $P_{H_2O}/P_{H_2} = 0.015$ under a heating velocity of 12.8°C/sec. and a soaking period of about 10 seconds. The magnetic properties of the steel strip obtained in this example and of a conventional steel strip obtained from the same molten steel by the usual ingot making method are compared in Table 1.

Table 1

| Magnetic properties | Magnetic flux density Wb/m² | | | | Iron loss Watt/kg | | | |
|---|---|---|---|---|---|---|---|---|
| | $B_{20}$ | | $B_{40}$ | | $W_{10/50}$ | | $W_{15/50}$ | |
| Example No. | L.C. | L/C | L.C | L/C | L.C | C/L | L.C | C/L |
| Inventive | 1.66 | 1.04 | 1.73 | 1.03 | 2.82 | 1.14 | 6.05 | 1.10 |
| [1]Conventional | 1.62 | 1.03 | 1.69 | 1.03 | 2.87 | 1.14 | 6.11 | 1.10 |
| Inventive | 1.57 | 1.07 | 1.68 | 1.06 | 1.65 | 1.40 | 3.72 | 1.34 |
| [2]Conventional | 1.53 | 1.07 | 1.53 | 1.05 | 1.70 | 1.41 | 3.77 | 1.34 |
| Inventive | 1.56 | 1.06 | 1.66 | 1.06 | 1.19 | 1.42 | 2.67 | 1.36 |

Table 1-continued

| Magnetic properties | Magnetic flux density Wb/m² | | | | Iron loss Watt/kg | | | |
|---|---|---|---|---|---|---|---|---|
| | $B_{20}$ | | $B_{40}$ | | $W_{10/50}$ | | $W_{15/50}$ | |
| Example No. | L.C. | L/C | L.C | L/C | L.C | C/L | L.C | C/L |
| [3]Conventional | 1.52 | 1.07 | 1.61 | 1.06 | 1.23 | 1.41 | 2.71 | 1.36 |

Remarks:
L.C . . . . . mean of lengthwise and cross directions
L/C . . . . . lengthwise/cross
C/L . . . . . cross/lengthwise
The conventional sheets in the above examples were obtained from molten steels having the same composition recited in the respective examples which was cast into a steel ingot and was subjected to breaking down with a reduction of more than 40% to obtain a slab having the same thickness of the continuously cast slab of the respective examples. The amount of columnar grains in those slabs was essentially zero.

What is claimed is:

1. A method for producing a cold rolled nondirectional electrical steel sheet or strip having a high magnetic flux density which comprises:

a. continuously casting molten steel containing 0.003 – 0.1% carbon, less than 4.0% silicon and less than 3.0% aluminum, which three components being controlled within the range defined in FIG. 8, into a slab at a temperature higher by about 30° to 70°C than the liquidus temperature, and solidifying the molten steel at a ratio of cooling water to molten steel of about 0.5 to 3 liters per Kg of steel, so as to produce a slab in which columnar grains cover more than 50% of the whole cross section or of the total thickness of the slab starting from both surfaces.

b. heating the slab uniformly to a temperature in the range of 1000° to 1350°C for a period selected to convert more than about 10% of the volume of the slab into gamma phase without breaking down the slab.

c. hot rolling the slab along the plane perpendicular to the direction of the developing columnar grains with a reduction of greater than about 98% to produce a sheet of intermediate gauge d. acid pickling the hot rolled sheet e. cold rolling the sheet with a reduction from about 64 – 84% f. heating the cold rolled sheet at a heating rate of from about 1.6° to 100°C/second; and g. annealing the material at a temperature between about 600° to 1200°C for more than 10 seconds.

* * * * *